US011421889B2

(12) United States Patent
Aguilar et al.

(10) Patent No.: US 11,421,889 B2
(45) **Date of Patent: *Aug. 23, 2022**

(54) CAP TO CHANGE INNER FLAME BURNER TO VERTICAL FLAME

(71) Applicant: WHIRLPOOL CORPORATION, Benton Harbor, MI (US)

(72) Inventors: Luis Javier Aguilar, Celaya (MX); Jonathan Tovar Balderas, Celaya (MX); Victor Ruelas Fajardo, Celaya (MX); Victor Gerardo Caloca Galindo, Celaya (MX); Ana Katia Silva Jiménez, Celaya (MX)

(73) Assignee: Whirlpool Corporation, Benton Harbor, MI (US)

( * ) Notice: Subject to any disclaimer, the term of this patent is extended or adjusted under 35 U.S.C. 154(b) by 405 days.

This patent is subject to a terminal disclaimer.

(21) Appl. No.: 16/555,294

(22) Filed: Aug. 29, 2019

(65) Prior Publication Data

US 2019/0383492 A1 Dec. 19, 2019

Related U.S. Application Data

(62) Division of application No. 15/287,147, filed on Oct. 6, 2016, now Pat. No. 10,436,451.

(51) Int. Cl.

| | |
|---|---|
| ***F24C 3/08*** | (2006.01) |
| ***F23D 14/06*** | (2006.01) |
| ***F23D 14/08*** | (2006.01) |
| ***F23D 14/58*** | (2006.01) |
| ***F23D 14/64*** | (2006.01) |
| ***F24C 3/02*** | (2021.01) |

(52) U.S. Cl.

CPC ..... *F24C 3/082* (2013.01); *F23D 14/06* (2013.01); *F23D 14/08* (2013.01); *F23D 14/58* (2013.01); *F23D 14/583* (2013.01); *F23D 14/64* (2013.01); *F24C 3/022* (2013.01)

(58) Field of Classification Search

CPC ..... F23D 14/06; F23D 14/08; F23D 14/58; F23D 14/583; F24C 3/082; F24F 13/06; F24F 13/062; F24F 2221/14; F24F 2221/50; F24F 7/10

USPC ..... 126/39 E, 39 R; 454/296

See application file for complete search history.

(56) References Cited

U.S. PATENT DOCUMENTS

| | | | |
|---|---|---|---|
| 1,376,241 | A | 4/1921 | Wright |
| 2,037,603 | A | 4/1936 | Sonn |
| 2,410,547 | A | 11/1946 | McCollum |
| 794,545 | A | 7/1957 | Phillips, Jr. |

(Continued)

FOREIGN PATENT DOCUMENTS

| | | | |
|---|---|---|---|
| EP | 0534301 | A2 | 4/1993 |
| EP | 2799771 | A2 | 5/2014 |

(Continued)

*Primary Examiner* — Vivek K Shirsat

(74) *Attorney, Agent, or Firm* — Price Heneveld LLP

(57) ABSTRACT

A burner assembly includes a spreader, a burner base, and at least one annular burner cap. The spreader has a bottom and a combustion chamber that is defined by a crenellated wall wherein a plurality of fuel exit portions defines the crenellated wall. The burner base includes a peripheral wall. The at least one annular burner cap is coupled to the peripheral wall of the burner base and is positioned on the crenellated wall.

17 Claims, 13 Drawing Sheets

(56) References Cited

U.S. PATENT DOCUMENTS

| | | | | |
|---|---|---|---|---|
| 2,805,710 | A | 9/1957 | Brumbaugh | |
| 4,583,941 | A | 4/1986 | Elperin et al. | |
| 5,437,262 | A | 8/1995 | George, II et al. | |
| 5,649,822 | A | 7/1997 | Gertler et al. | |
| 6,318,993 | B1 | 11/2001 | Huang | |
| 6,619,280 | B1 | 9/2003 | Zhou et al. | |
| 6,832,607 | B2 | 12/2004 | Zhou et al. | |
| 7,083,123 | B2 | 8/2006 | Molla | |
| 7,094,050 | B2 | 8/2006 | Inomata | |
| 7,101,174 | B2 | 9/2006 | Tomiura et al. | |
| 7,819,657 | B2 | 10/2010 | Molla | |
| 7,901,205 | B2 | 3/2011 | Trochou | |
| 7,942,143 | B2 | 5/2011 | Lee et al. | |
| 8,220,450 | B2 | 7/2012 | Luo et al. | |
| 8,616,193 | B2 | 12/2013 | Padgett | |
| 8,689,782 | B2 | 4/2014 | Padgett | |
| 8,899,972 | B2 | 12/2014 | Fowler | |
| 8,951,040 | B2 | 2/2015 | Rasi | |
| 9,086,221 | B2 | 7/2015 | Lona Santoyo et al. | |
| 9,416,963 | B2 | 8/2016 | Armanni | |
| 10,436,451 | B2 * | 10/2019 | Aguilar | F23D 14/583 |
| 2004/0029063 | A1 | 2/2004 | Bettinzoli | |
| 2005/0112520 | A1 | 5/2005 | Todoli et al. | |
| 2005/0277079 | A1 | 12/2005 | Wu | |
| 2005/0277080 | A1 | 12/2005 | Wu | |
| 2006/0024632 | A1 | 2/2006 | Sanchez | |
| 2006/0147865 | A1 * | 7/2006 | Czajka | F24C 3/085 431/354 |
| 2009/0087804 | A1 | 4/2009 | Pryor et al. | |
| 2009/0320823 | A1 | 12/2009 | Padgett | |
| 2010/0126496 | A1 | 5/2010 | Luo et al. | |
| 2010/0154776 | A1 | 6/2010 | Czajka | |
| 2010/0186730 | A1 | 6/2010 | Cadeau et al. | |
| 2010/0163013 | A1 | 7/2010 | Serenellini et al. | |
| 2010/0206293 | A1 | 8/2010 | Padgett | |
| 2010/0319677 | A1 | 12/2010 | Lacche | |
| 2011/0048400 | A1 | 3/2011 | Biagioli et al. | |
| 2011/0086318 | A1 | 4/2011 | Schwierking et al. | |
| 2011/0120445 | A1 | 5/2011 | Armanni | |
| 2011/0143295 | A1 | 6/2011 | Fowler | |
| 2011/0151385 | A1 | 6/2011 | Santoyo et al. | |
| 2011/0232628 | A1 | 9/2011 | Bettinzoli | |
| 2013/0199513 | A1 | 8/2013 | Bettinzoli | |
| 2013/0269676 | A1 | 10/2013 | Quintaba' et al. | |
| 2014/0116417 | A1 | 5/2014 | Dora | |
| 2014/0318528 | A1 | 10/2014 | Quintaba' et al. | |
| 2014/0345598 | A1 | 11/2014 | Da Silva et al. | |
| 2015/0040887 | A1 * | 2/2015 | Angulo | F24C 3/085 126/39 E |
| 2015/0107577 | A1 | 4/2015 | Jeong et al. | |
| 2018/0100655 | A1 | 4/2018 | Aguilar et al. | |

FOREIGN PATENT DOCUMENTS

| | | | |
|---|---|---|---|
| FR | 400388 | | 7/1909 |
| JP | 56030521 | A | 3/1987 |
| JP | 2006098001 | A | 4/2006 |
| WO | 2012143319 | A1 | 10/2012 |

* cited by examiner

CAP TO CHANGE INNER FLAME BURNER TO VERTICAL FLAME

CROSS-REFERENCE TO RELATED APPLICATION

This application is a divisional of U.S. patent application Ser. No. 15/287,147, now U.S. Pat. No. 10,436,451, filed Oct. 6, 2016, and entitled "CAP TO CHANGE INNER FLAME BURNER TO VERTICAL FLAME," which is incorporated herein by reference in its entirety.

FIELD

The present disclosure generally relates to a gas burner that may have its flame manipulated by using burner caps.

BACKGROUND

Gas powered cooking appliances, such as standalone cooking hobs or cooking hobs included in gas or multi-fuel ranges often include gas burners. Gas burners are used in all types of applications including cooking appliances and especially in cooktop systems. There are several burner/system design configurations available today but none that offer methods to control the flame other than individual burner knobs. The ability to change the flame on a gas burner for both functional and aesthetic reasons may be desired by users.

SUMMARY

According to one aspect of the present disclosure, a burner cap set for a gas burner includes a burner base. The burner base includes a peripheral wall that has a base edge. The burner cap set includes a spreader. The spreader includes a bottom and a crenellated wall that has a top portion and a front edge. The bottom and the crenellated wall defines a combustion chamber. A plurality of fuel exit ports is defined by the crenellated wall, the fuel exit ports being directed generally inwardly toward the combustion chamber and upwardly from the bottom of the combustion chamber. An inner flame burner cap is coupled to the top portion of the crenellated wall that defines an inner flame state projected into the combustion chamber. A vertical flame burner cap is coupled to the top portion of the crenellated wall to define an inner flame state upwardly from the gas burner. The vertical flame state is alternate from the inner flame state. The vertical flame burner cap includes a first inner edge and a second inner edge. The first and second inner edges are respectively coupled to the crenellated wall and the peripheral wall.

According to another aspect of the present disclosure, a burner assembly includes a spreader, a burner base, and at least one annular burner cap. The spreader has a bottom and a combustion chamber that is defined by a crenellated wall wherein a plurality of fuel exit portions defines the crenellated wall. The burner base includes a peripheral wall. The at least one annular burner cap is coupled to the peripheral wall of the burner base and is positioned on the crenellated wall.

According to another aspect of the present disclosure, a gas burner includes a spreader, a burner base, and an annular burner cap. The spreader includes a bottom and a crenellated wall that is defined by a combustion chamber. The crenellated wall has a top portion and is defined by fuel exit ports. The burner base includes a peripheral wall and a ledge member that extends from the peripheral wall. The annular burner cap is coupled to the peripheral wall of the burner base and is positioned on the top portion of the crenellated wall.

These and other features, advantages, and objects of the present device will be further understood and appreciated by those skilled in the art upon studying the following specification, claims, and appended drawings.

DETAILED DESCRIPTION OF EMBODIMENTS

Figure 1:
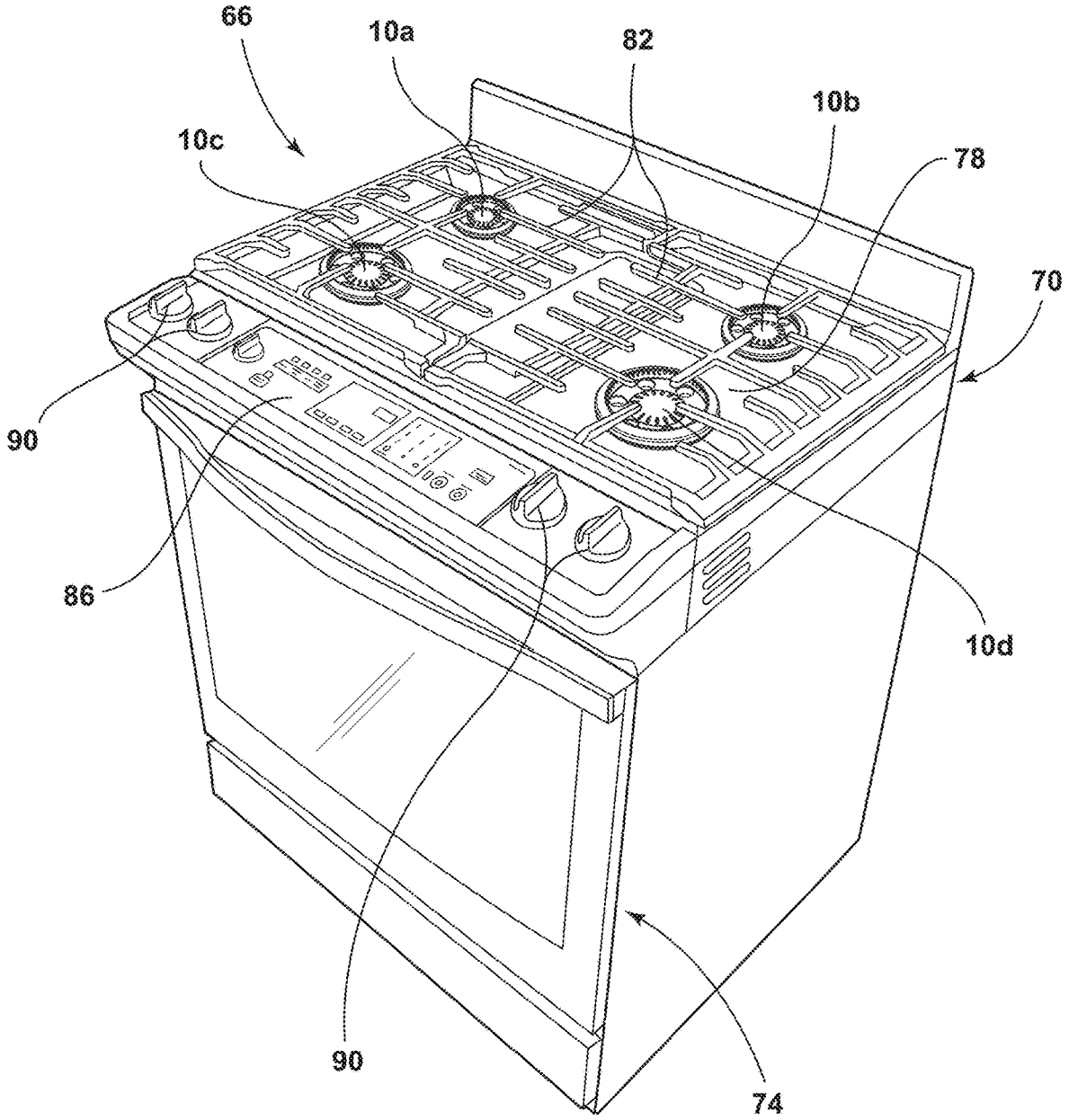
FIG. 1 is a front perspective view of a gas range.

Reference will now be made in detail to the present embodiments, examples of which are illustrated in the accompanying drawings. Whenever possible, the same reference numerals will be used throughout the drawings to refer to the same or like parts.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1-14, reference numeral 10 generally designates a gas burner having a switchable flame 14. The gas burner 10 includes a combustion chamber 18 having a bottom 22 and a circumferential crenellated wall 26 with a plurality of fuel exit ports 30 disposed in the circumferential crenellated wall 26. The fuel exit ports 30 are directed generally inwardly toward the combustion chamber 18 and also upwardly from the bottom 22 of the combustion chamber 18. The gas burner 10 additionally includes a burner base 34 and a swirl spreader 38 disposed above the burner base 34 which defines a top portion 42 of the circumferential crenellated wall 26 of the combustion chamber 18. An annular burner cap set 46 includes an inner flame burner cap 50 and a vertical flame burner cap 54 where the inner flame burner cap 50 and the vertical flame burner cap 54 are selectively and alternatively positioned on the circumferential crenellated wall 26 to define an inner flame state 58 and a vertical flame state 62, respectively, of the fuel exit ports 30.

Referring now to FIG. 1, a gas range 66 includes a cooking hob 70 positioned on the top of an oven 74. The cooking hob 70 can include a plurality of gas-burning heating elements in the form of various "burners" 10*a*, 10*b*, 10*c*, 10*d*, (which may be referred to generically or collectively as gas burner 10). The gas burners 10 are positioned in a cooktop 78 and are covered with a burner grate 82. A control panel 86 positioned on the front of the cooktop 78 may include one or more burner dials 90 to control the flow of a fuel 210 (FIGS. 7B and 12B) to the gas burners 10.

Figure 2:
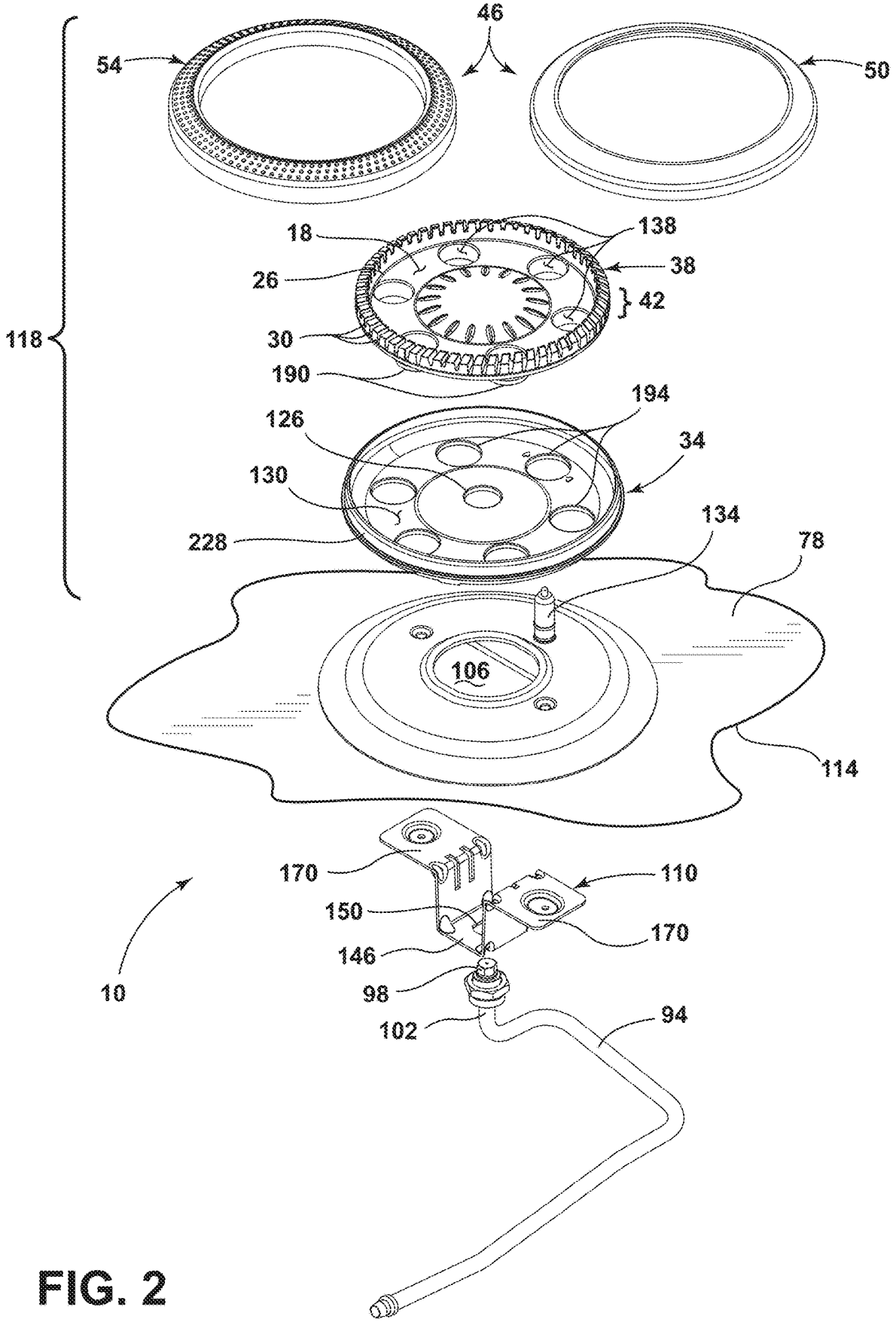
FIG. 2 is an exploded top isometric view of an embodiment of a gas burner for a gas range according to the present disclosure.

With reference to FIG. 2, the gas burner 10 for a cooktop 78 has a gas inlet 94 that supplies fuel to the burner 10 through an injector orifice 98 at its terminal end 102. The injector orifice 98 is secured in position below a cooktop aperture 106 with a bracket 110 that is fastened to an underside 114 of the cooktop 78. A burner assembly 118 includes a gas flow path through a stem 122 (shown in FIG. 3), a venturi tube 126, a mixing chamber 130, fuel exit ports 30, and the combustion chamber 18. Fuel is supplied to the burner 10 through the gas inlet 94. Primary air is introduced to the venturi tube 126 to form a combustible gas-primary air mixture in the mixing chamber 130. The gas-primary air mixture is then expelled through the plurality of fuel exit ports 30 into the combustion chamber 18, where a spark electrode 134 is disposed to ignite the gas-primary air mixture. Secondary air inlets 138 extend from the combustion chamber 18 to ambient air outside the burner assembly 118, allowing secondary air to be drawn into the combustion chamber 18 by convection to encourage complete combustion. The burner assembly 118 as depicted in the embodiment of FIG. 2 includes the burner base 34, swirl spreader 38, and the annular burner cap set 46, which define the functional elements of the stem 122, venturi tube 126, mixing chamber 130, plurality of fuel exit ports 30, and the combustion chamber 18. Although shown as three parts that are assembled to form the burner assembly 118 in the embodiment depicted in FIG. 2, the functional elements of the burner assembly 118 may be constructed out of more or less assembled parts, and may be integrally formed in a single piece, if desired. The annular burner cap set 46 includes both the inner flame burner cap 50 and the vertical flame burner cap 54. In addition to embodiments where both the inner flame burner cap 50 and the vertical flame burner cap 54 are round or circular shaped, the inner flame burner cap 50 and the vertical flame burner cap 54 may be a variety of other shapes, for example a radial, circular, oval, square, or triangular shape so that it can be positioned on the top portion 42 of the circumferential crenellated wall 26.

Figure 3:
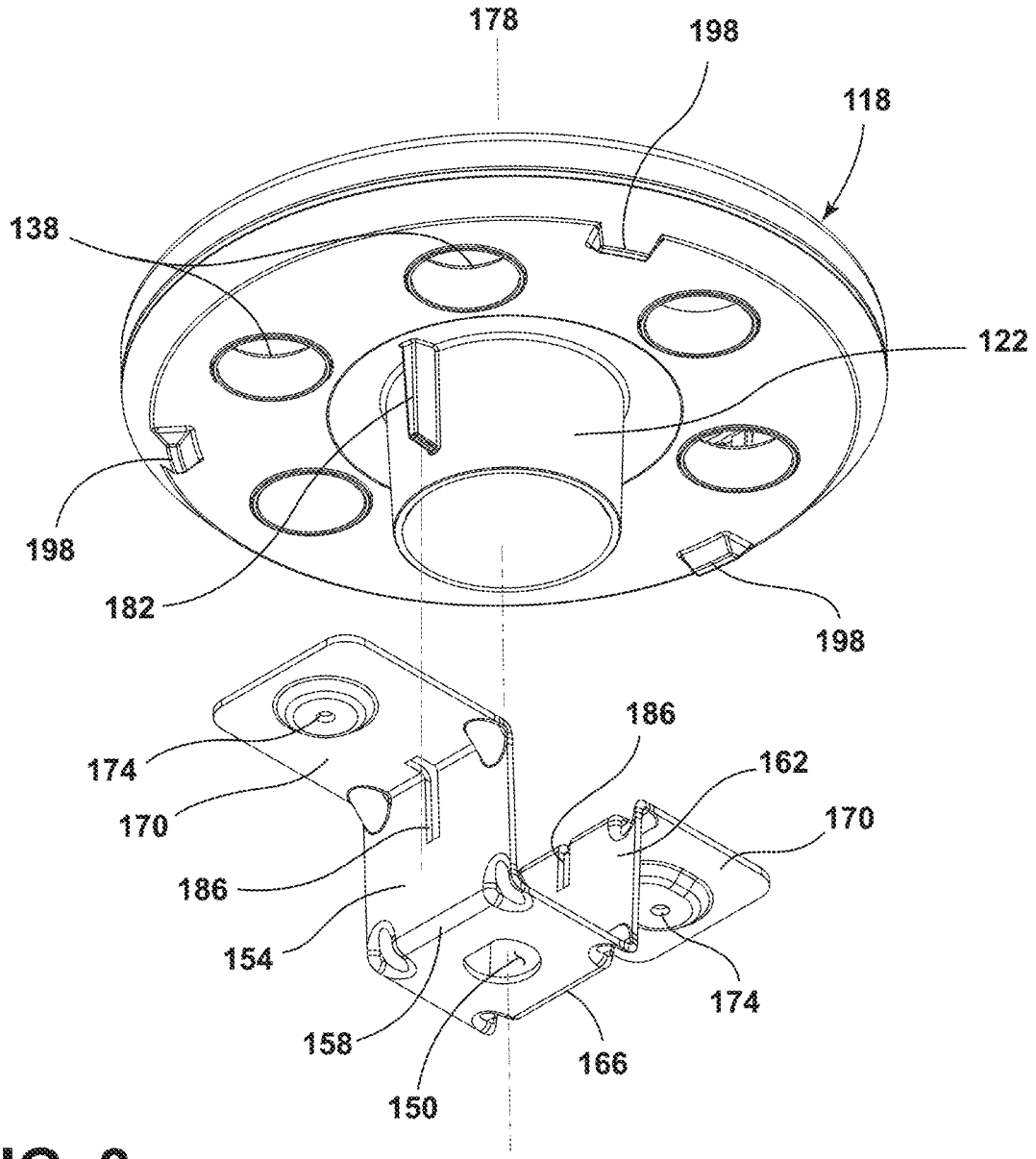
FIG. 3 is a bottom isometric view of the disassembled burner shown in FIG. 2 (with cooktop and gas inlet omitted for clarity)
Figure 4:
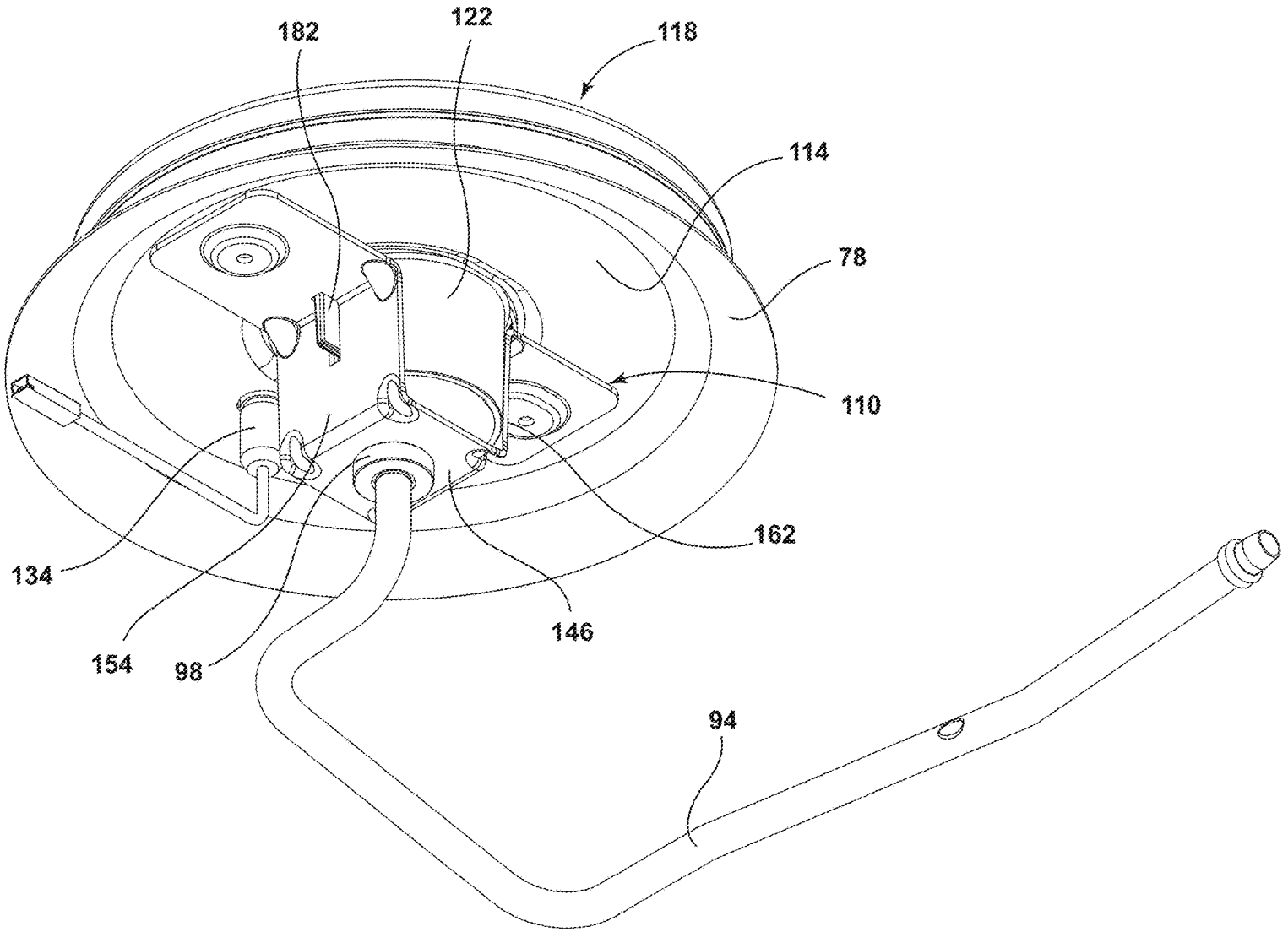
FIG. 4 is a bottom isometric view of the assembled burner shown in FIG. 2.

Referring now to FIGS. 2-4, the bracket 110 used to secure the gas inlet 94 includes an orifice-securing surface 146 with a hole 150 therethrough for passage of the gas inlet 94, with the injector orifice 98 held in place above the orifice-securing surface 146. The orifice-securing surface 146 shown herein is generally planar and parallel to the underside 114 of the cooktop 78, and is generally square or rectangular shaped. Alternate embodiments may include alternate designs of the orifice-securing surface 146, including without limitation curved edges, a non-planar shape, a slot for passage of the gas inlet 94, etc. A first sidewall 154 extends upwardly from a first edge 158 of the orifice-securing surface 146, and a second sidewall 162 extends upwardly from a second edge 166 of the orifice-securing surface 146. Each sidewall 154, 162 terminates in an outwardly directed fastening flange 170. The fastening flanges 170 have through holes 174 therethrough, for fastening the bracket 110 to the cooktop 78 with the fastening flanges 170 on opposing sides of the cooktop aperture 106. The first sidewall 154 and second sidewall 162 are separated by a distance which is less than the diameter of the cooktop aperture 106, resulting in a portion of each of the fastening flanges 170 being aligned below the cooktop aperture 106. The bracket 110 is secured to the cooktop 78 by positioning it below the cooktop 78 and fastening the bracket 110 to the underside 114 thereof using fasteners (not shown). The bracket 110, when installed, positions the injector orifice 98 generally in the center of the cooktop aperture 106, and, therefore, along a central axis 178 of the gas burner 10.

Also as shown in FIGS. 2-4, the burner assembly 118 is removably secured to the bracket 110 in the desired orientation by aligning a plurality of tabs 182 extending outwardly from the stem 122 with slots 186 that extend through the fastening flanges 170 and sidewalls 154, 162 of the bracket 110, such that the burner assembly 118 is properly aligned with the injector orifice 98. When aligned, the injector orifice 98 directs the flow of fuel upward into the stem 122 and venturi tube 126. The slots 186 and the bracket 110 are asymmetrically arranged, with two slots 186 on the first sidewall 154 of the bracket 110 and one slot 186 on the second sidewall 162 of the bracket 110, and a corresponding tab 182 on the side of the stem 122 and one tab 182 on an opposing side of the stem 122. The asymmetrical alignment allows the burner assembly 118 to be secured to the bracket 110 in a single orientation, and prevents the use of alternate burner assemblies that are not optimized for use with the particular injector orifice 98 used. As a non-limiting example, when the burner assembly 118, gas inlet 94, and injector orifice 98 are optimized for high efficiency operation, the particular asymmetrical arrangement of slots 186 and tabs 182 can be used to ensure that alternate burner assemblies are not installed into the cooking aperture 106.

Also as shown in the embodiments depicted in FIGS. 2-4, the secondary air inlets 138 extend from the combustion chamber 18, through the mixing chamber 130 to ambient air. The secondary air inlets 138 permit the inflow of secondary air to enhance combustion characteristics of the burner 10. As shown in FIGS. 2-4, the secondary air inlets 138 include downwardly depending cylinders 190 which extend from the swirl spreader 38 to apertures 194 in the burner base 34, to create a channel for the flow of secondary air through the mixing chamber 130 (where the secondary air is fluidly separated from the mixing chamber 130). The number of secondary air inlets 138 and their cross-sectional area can be varied to provide desired burner characteristics for the gas burner 10. In the embodiment depicted in FIGS. 2-4, there are six secondary air inlets 138 provided, and they are evenly spaced about the circumference of the gas burner 10. The burner assembly 118 is raised off of the surface of the cooktop 78 to permit air to enter the secondary air inlets 138 by feet 198 extending downwardly from the burner assembly 118.

Figure 5A:
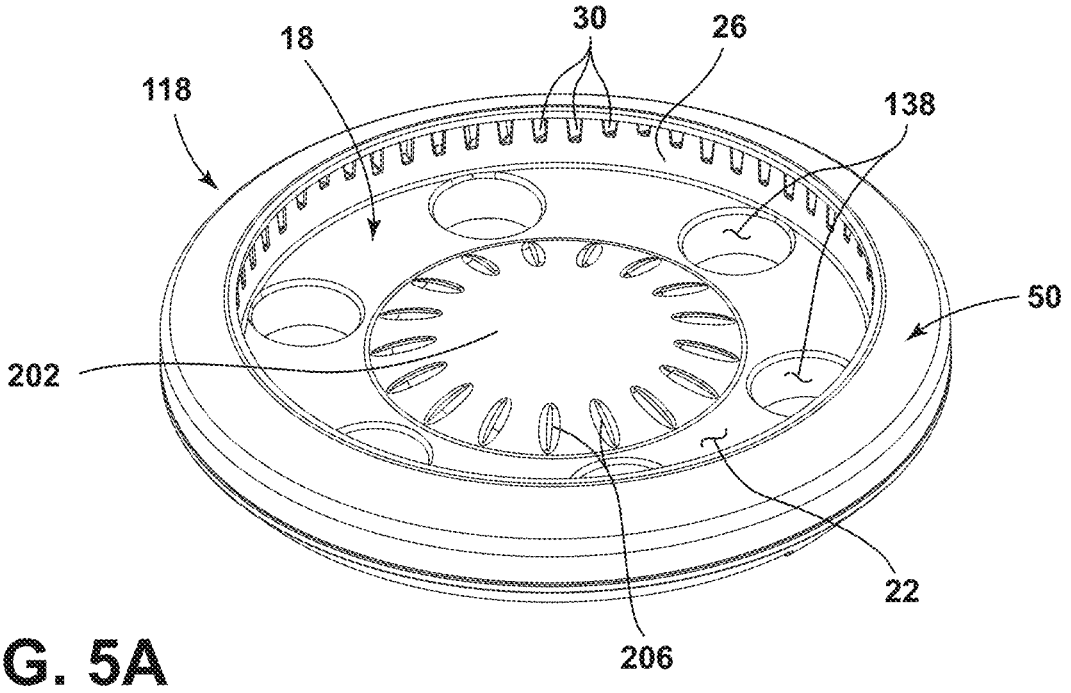
FIG. 5A is a top isometric view of the assembled burner shown in FIG. 2 with the inner flame cap (with cooktop and gas inlet omitted for clarity)
Figure 5B:
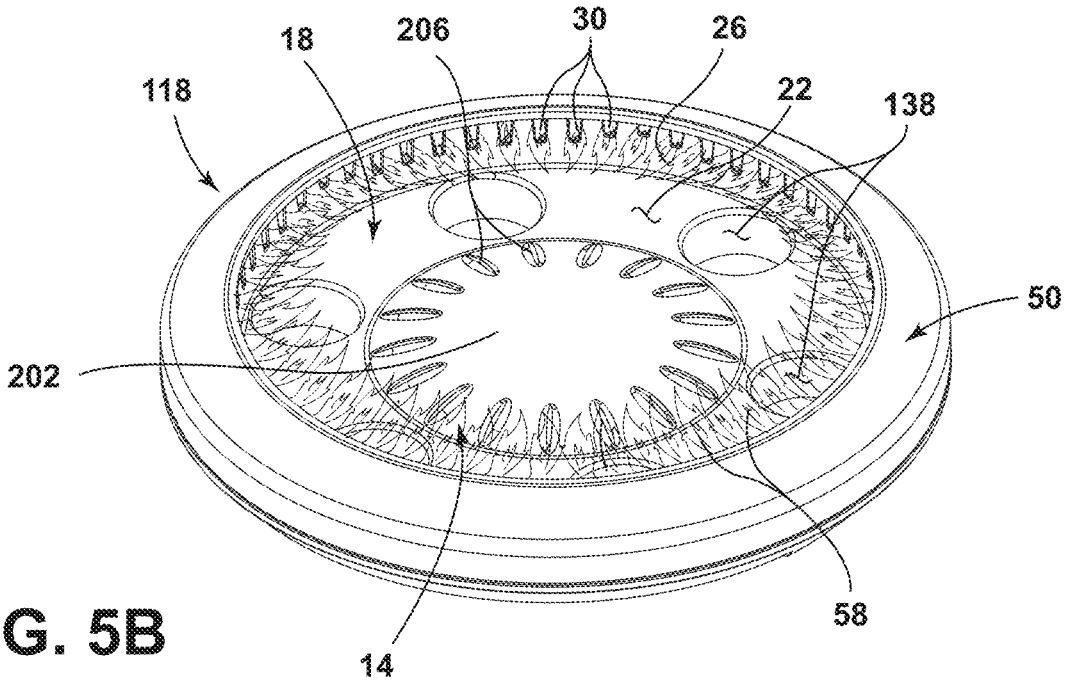
FIG. 5B is a top isometric view of the assembled burner shown in FIG. 5A in use with an inner flame.

Referring now to FIGS. 5A-5B, the burner assembly 118 has its combustion chamber 18 partially defined by the bottom 22, the circumferential crenellated wall 26, and the plurality of fuel exit ports 30. One or more secondary air inlets 138 may be formed in the bottom 22 of the combustion chamber 18, and they may be evenly spaced about the circumference of the bottom 22 of the combustion chamber 18. The venturi tube 126 (FIG. 2) has a venturi tube cover 202 that may have a plurality of venturi tube ornamental marks 206 covering it. FIG. 5B depicts the inner flame state 58 where the flames are directed inwardly to the combustion chamber 18 by the inner flame burner cap 50. As used herein, the term "switchable flame" 14 collectively refers to both the inner flame state 58 and the vertical flame state 62 where the flame can be switched between the inner flame state 58 produced by the inner flame burner cap 50 and the vertical flame state 62 produced by the vertical flame burner cap 54 at any time as determined by the user.

Figure 6:
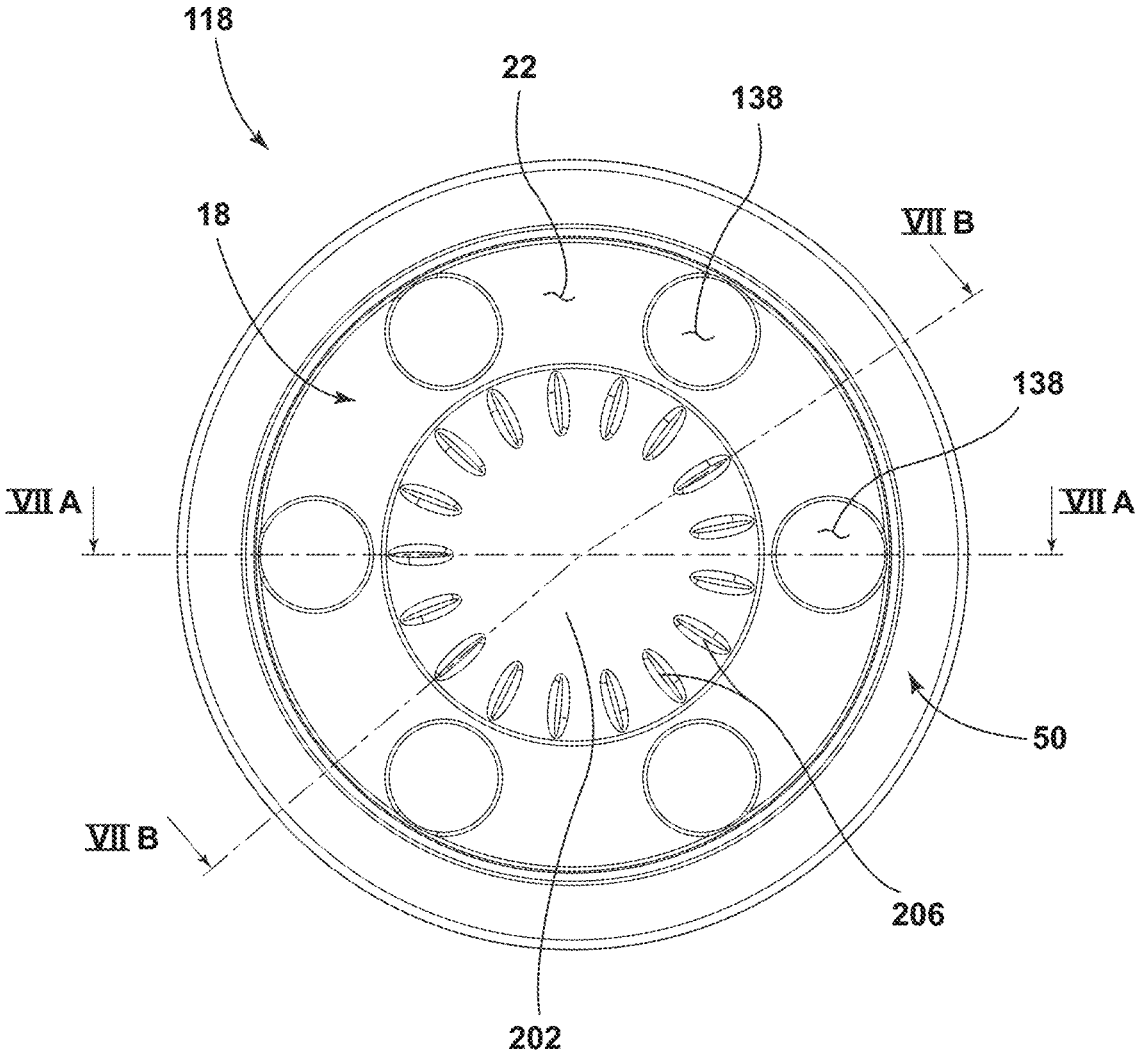
FIG. 6 is a top plan view of the assembled burner shown in FIG. 5A with the inner flame cap.

FIG. 6 depicts a top view of the burner assembly 118 with the combustion chamber 18 having its bottom 22 and secondary air inlets 138 encircling the venturi tube cover 202 with its plurality of venturi tube ornamental marks 206. The top view of the burner assembly 118 additionally illustrates the inner flame burner cap 50 covering the top portion 42 of the circumferential crenellated wall 26 (not shown) of the burner assembly 118.

Figure 7A:
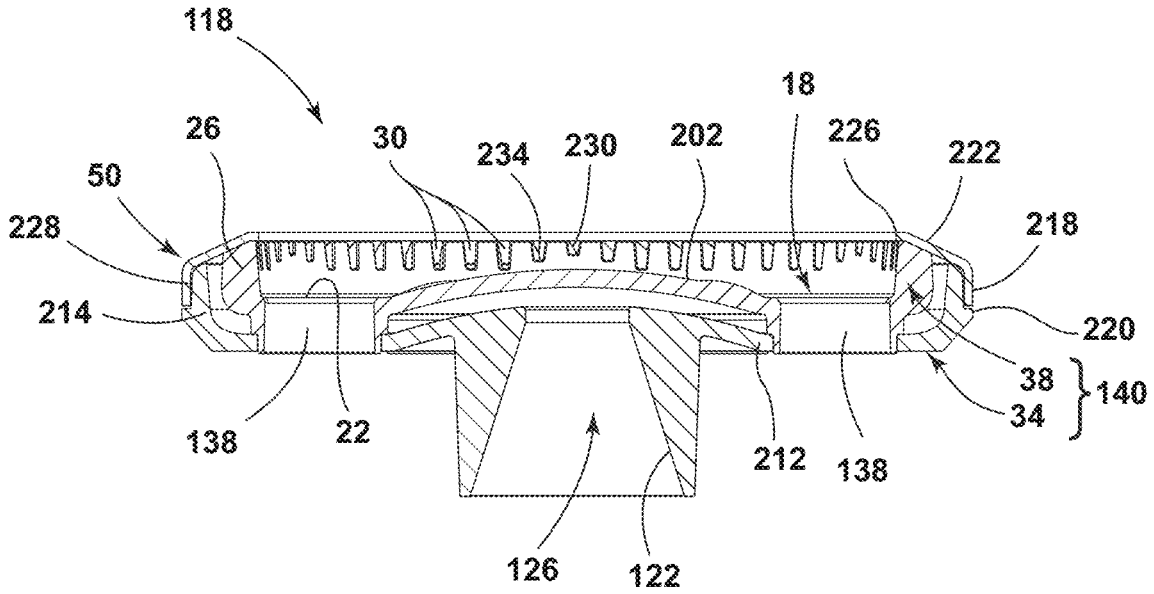
FIG. 7A is a cross-sectional view of the burner base taken along the line VII-VII shown in FIG. 6.
Figure 7B:
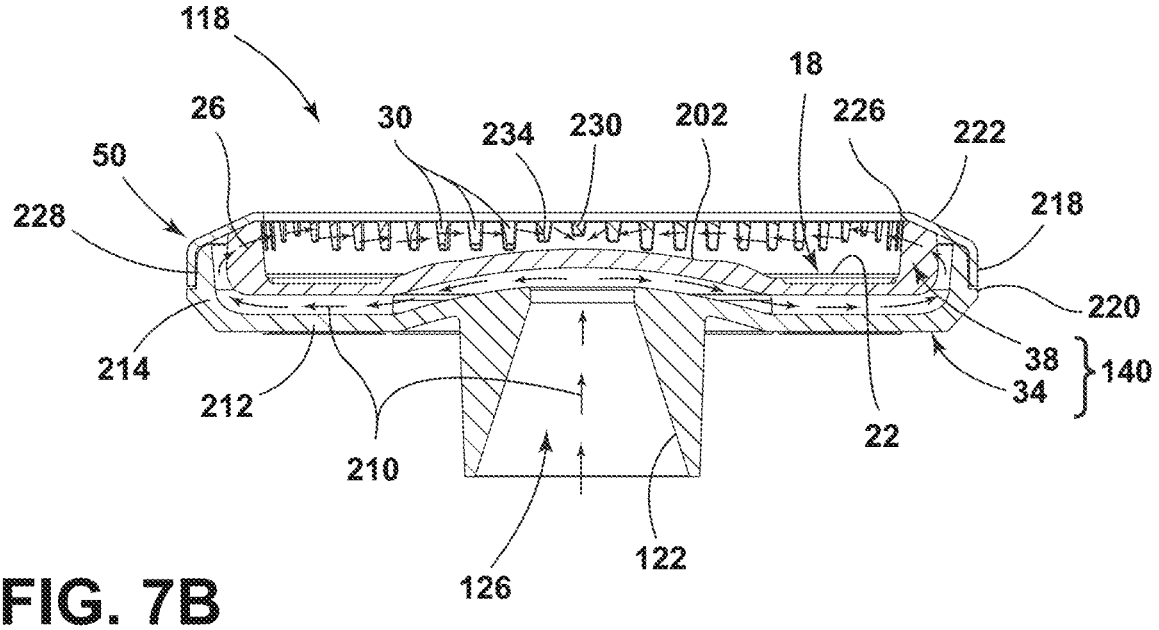
FIG. 7B is a cross-sectional view of the burner base taken along the line VII-VII shown in FIG. 6 with the flow of fuel shown.

With reference to FIGS. 7A-7B, a cross-sectional view of the burner assembly 118 is shown to demonstrate the flow of the fuel 210 throughout the gas burner 10. The fuel 210 flows upward through the venturi tube 126 enclosed by the stem 122 wherein the fuel 210 then flows up against the venturi tube cover 202 and flows out across a bottom plate 212 out against a peripheral wall 214 and out through the plurality of fuel exit ports 30 as directed by the inner flame burner cap 50 positioned on top of the circumferential crenellated wall 26. The inner flame burner cap 50 has an outer cap wall 218, an annular wall 222, and a top cap wall 226 that direct the flow of fuel 210 through the plurality of fuel exit ports 30 into the combustion chamber 18 (not shown) of the burner assembly 118. At least one secondary air inlet 138 is shown to encourage complete combustion in combustion chamber 18. The outer cap wall 218 slides down along the peripheral wall 214 to leave a small gap between the outer cap wall 218 and a ledge member 220. A spreader assembly 140 includes both the swirl spreader 38 and the burner base 34 upon which the inner flame burner cap 50 is positioned. The outer cap wall 218 couples to a back edge 228 of the peripheral wall 214 of the burner base 34.

The plurality of fuel exit ports 30 in the circumferential crenellated wall 26 direct the fuel 210 in both an inwardly and upwardly directed swirling configuration. By selectively directing the fuel 210 in the inwardly or upwardly direction using the inner flame burner cap 50 or vertical flame burner cap 54, the user may selectively use the inner flame state 58 or the vertical flame state 62. In some embodiments, the inner flame burner cap 50 is coupled to the swirl spreader 38 to block the fuel exit ports 30 directed generally upwardly from the bottom 22 of the combustion chamber 18. In embodiments where the inner flame burner cap 50 is coupled to the swirl spreader 38, the inner flame burner cap 50 blocks the fuel exit ports 30 directed generally upwardly from the bottom 22 of the combustion chamber 18 with its annular wall 222. The fuel 210 is then directed inwardly towards the combustion chamber 18 to form the inner flame state 58 once the fuel 210 is ignited. In other embodiments, the plurality of fuel exit ports 30 are directed inwardly at an angle that is slightly rotated from the central axis or radial line 178 through a center of the gas burner 10 to create the inner flame state 58.

Figure 8:
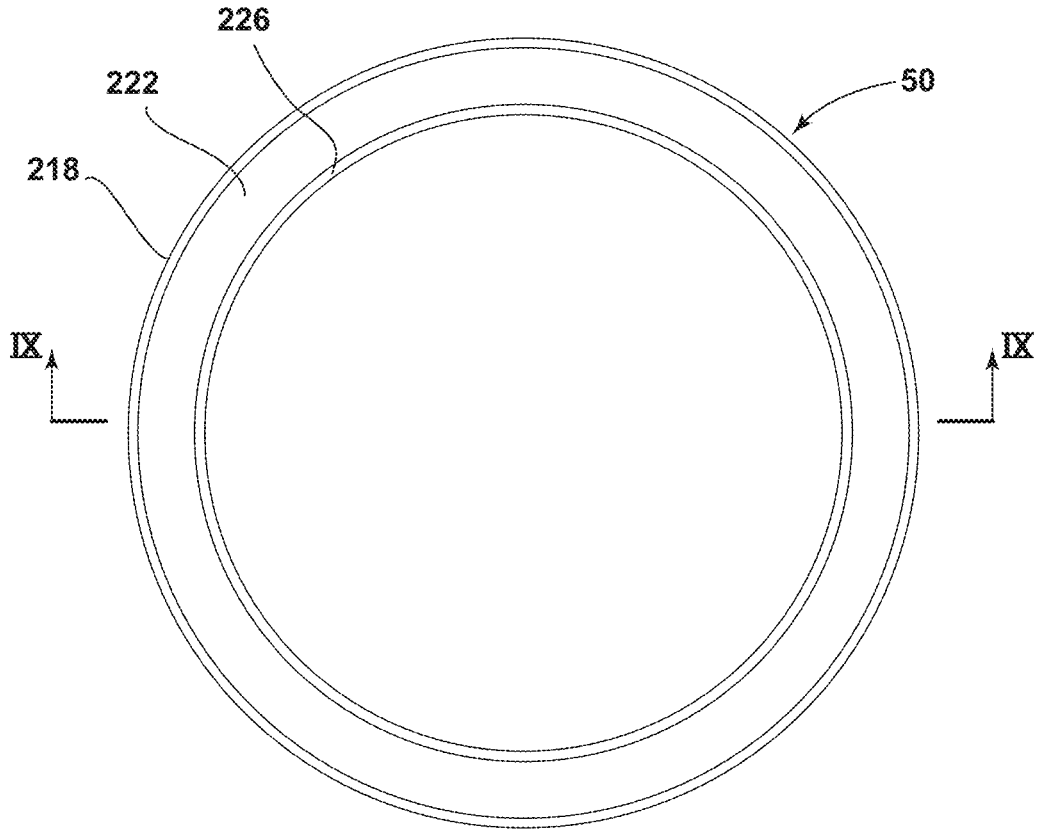
FIG. 8 is a top plan view of an inner flame cap according to the present disclosure.
Figure 9:
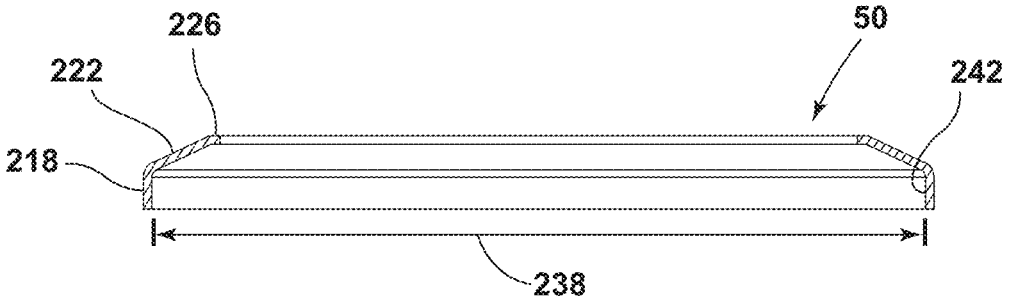
FIG. 9 is a cross-sectional view of the inner flame cap taken along the line IX-IX in FIG. 8.

Referring now to FIGS. 2 and 8-9, the inner flame burner cap 50 includes the inner flame burner cap 50 positioned on top of the spreader assembly 140, where it encloses the top of the mixing chamber 130 between the peripheral wall 214 of the burner base 34 and the circumferential crenellated wall 26 of the swirl spreader 38. The inner flame burner cap 50 also encloses the top 234 of the channels 230, to direct the flow of fuel 210 inwardly toward the combustion chamber 18. The inner flame burner cap 50 is optionally shaped and has a diameter 238 that extends the outer burner cap wall 218 over a portion of the peripheral wall 214 of the burner base 34, to retain the inner flame burner cap 50 in position. An outer wall inner surface 242 contacts the peripheral wall 214 of the burner base 34 and the outer cap wall 218 is pushed down against the ledge member 220 (FIG. 7A). The inner flame burner cap 50 may also be constructed of any material suitable for use in burner caps, including without limitation a suitable polished brass alloy, iron, or a steel material formed by stamping and sintering metal powder.

The fuel 210 is supplied to the gas burner 10 through the gas inlet 94, and is sprayed through the gas injector orifice 98, into the stem 122. The fuel 210 then travels through the venturi tube 126, where primary air is introduced. The gas and primary air are expelled into the mixing chamber 130, which is defined by the burner base 34, the swirl spreader 38, and the inner flame burner cap 50. The gas and primary air mixture is then forced through the plurality of fuel exit ports 30 by pressure in the mixing chamber 130, into the combustion chamber 18. The plurality of fuel exit ports 30 direct the gas in an inwardly and upwardly directed swirling configuration. The gas-primary air mixture is ignited in the combustion chamber 18 by the spark electrode 134, and the swirling upwardly directed flame causes secondary air to enter the combustion chamber 18 through the secondary air inlets 138 in the bottom of the combustion chamber 18 by convection to encourage complete combustion.

The gas burner 10 disclosed herein using the inner flame burner cap 50 provides several advantages. For example, cookware placed on the inner flame burner cap 50 is heated effectively and efficiently by the swirling inwardly directed flames, with limited heat loss around the exterior of the cookware. Efficiencies of 60% or greater are possible with the inwardly swirling directed flames as described herein. The inwardly directed flames also reduced the risk of a user being burned by the flames, as they are directed to be underneath the cookware. Additionally, the embodiments described herein are resistant to spillage, without openings or holes facing the top of the gas burner 10 where cookware is placed. The aesthetics of the gas burner 10 are improved due to the smooth, uninterrupted viewable surface. The gas burner 10 described herein can also be removed from the cooktop 78 without disconnecting the injector orifice 98, which is secured using the bracket 110, and replaced in a proper orientation using the asymmetrically arranged tabs 182 and slots 186 described herein.

Figure 10A:
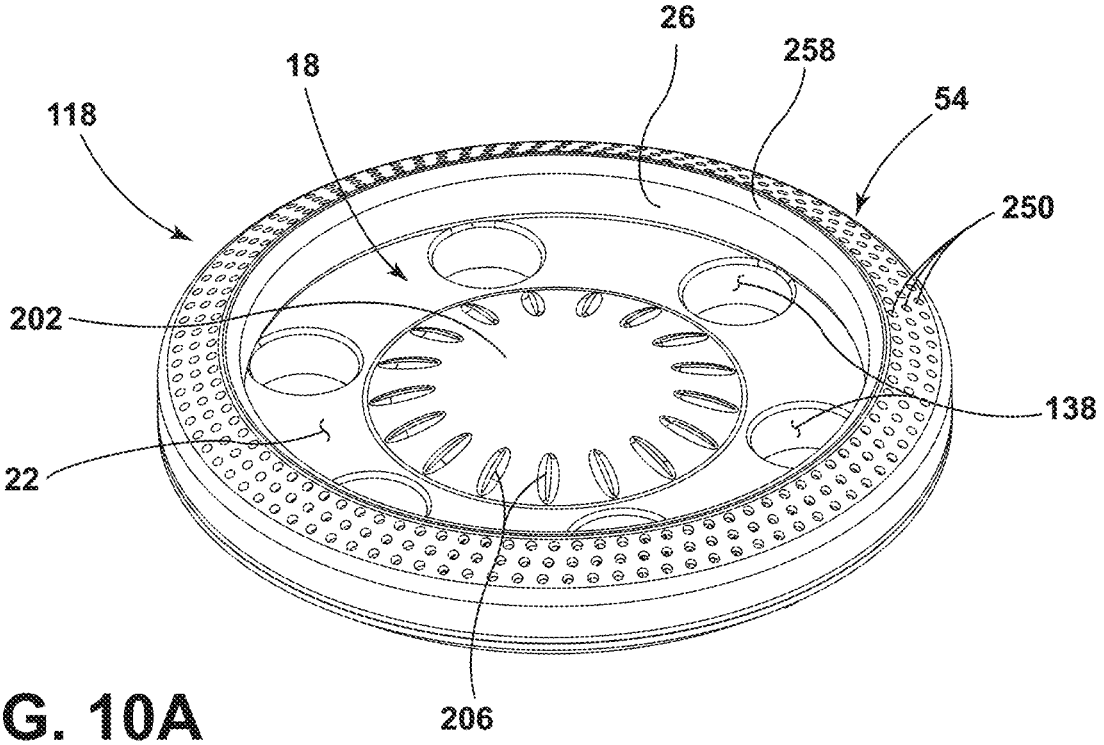
FIG. 10A is a top isometric view of the assembled burner shown in FIG. 2 with a vertical flame cap (with cooktop and gas inlet omitted for clarity)
Figure 10B:
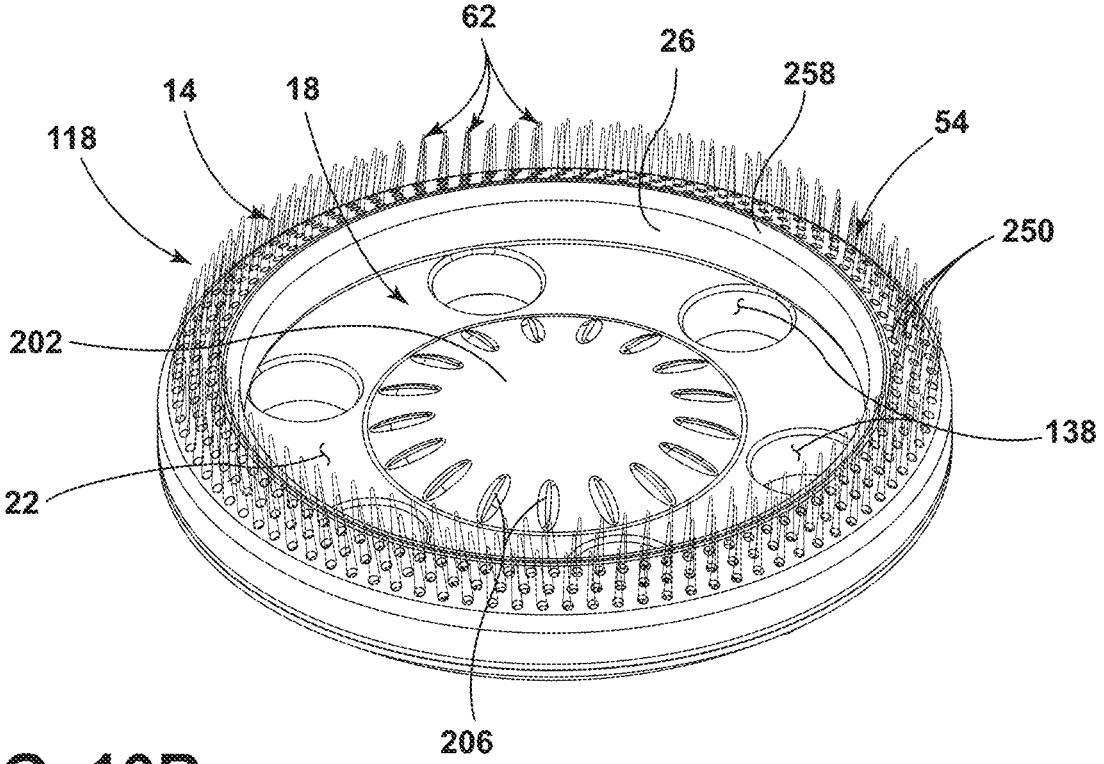
FIG. 10B is a top isometric view of the assembled burner shown in FIG. 10A in use with a vertical flame.

Referring now to FIGS. 10A-10B, the burner assembly 118 has its combustion chamber 18 partially defined by the bottom 22, and the circumferential crenellated wall 26 with its plurality of fuel exit ports 30 covered by the vertical flame burner cap 54. One or more secondary air inlets 138 may be formed in the bottom 22 of the combustion chamber 18, and they may be evenly spaced about the circumference of the bottom 22 of the combustion chamber 18. The venturi tube 126 has a venturi tube cover 202 that may have the plurality of venturi tube ornamental marks 206 covering it. The vertical flame burner cap 54 is coupled to the swirl spreader 38 of the circumferential crenellated wall 26 and the vertical flame burner cap 54 blocks the plurality of fuel exit ports 30 directed generally inwardly to route the fuel 210 upwardly to produce the vertical flame state 62. FIG. 5B depicts the vertical flame state 62 that is directed upwardly away from the burner assembly 118 through one or more flame apertures 250 in the vertical flame burner cap 54.

Figure 11:
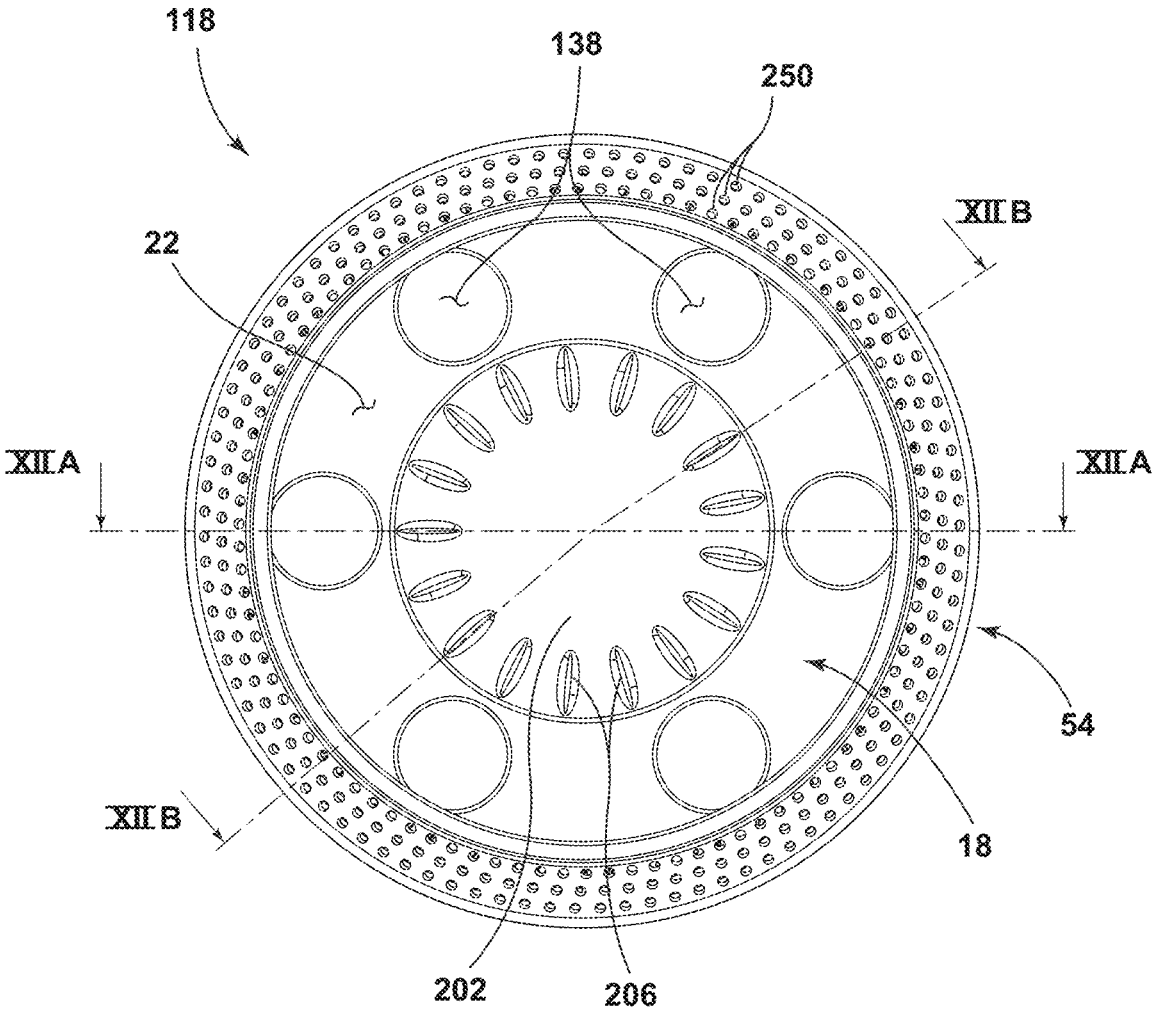
FIG. 11 is a top plan view of the assembled burner shown in FIG. 10A with the vertical flame cap.

FIG. 11 depicts a top view of the burner assembly 118 with the combustion chamber 18 having its bottom 22 and secondary air inlets 138 encircling the venturi tube cover 202 with its plurality of venturi tube ornamental marks 206. The top view of the burner assembly 118 additionally illustrates the vertical flame burner cap 54 covering the circumferential crenellated wall 26 of the burner assembly 118.

Figure 12A:
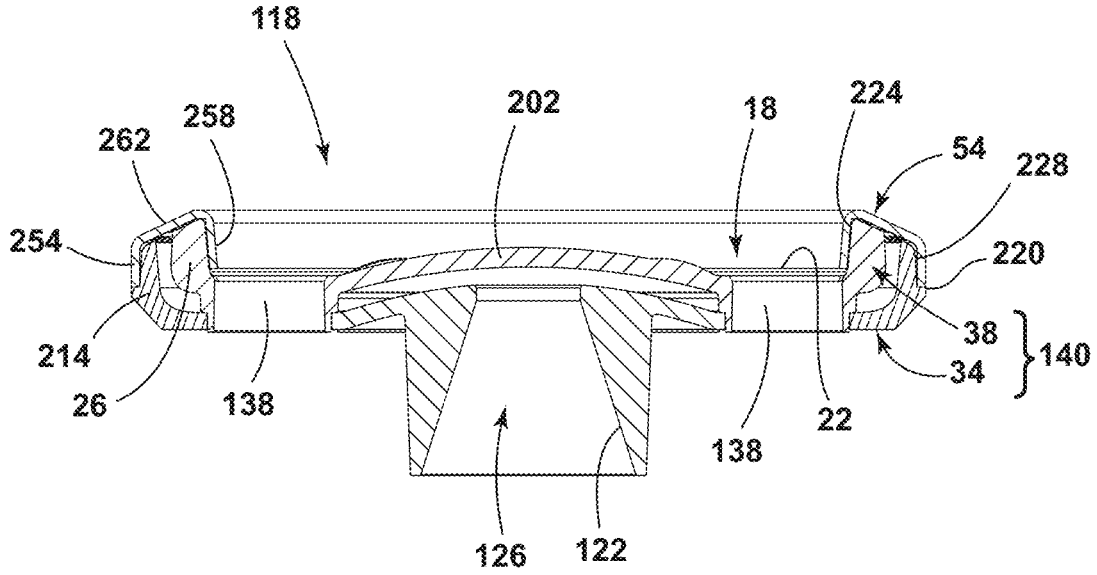
FIG. 12A is a cross-sectional view of the burner base taken along the line XII-XII shown in FIG. 11.
Figure 12B:
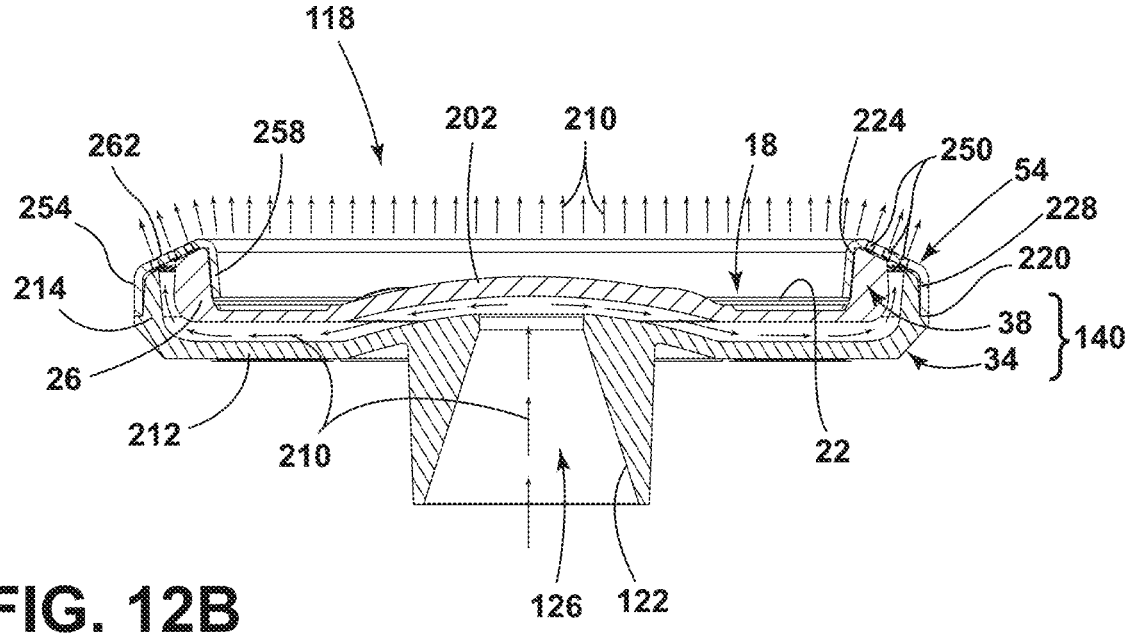
FIG. 12B is a cross-sectional view of the burner base taken along the line XII-XII shown in FIG. 11 with the flow of fuel shown.

With reference to FIGS. 12A-12B, a cross-sectional view of the burner assembly 118 is shown to demonstrate the flow of fuel 210 throughout the gas burner 10. The fuel 210 flows upward through the venturi tube 126 enclosed by the stem 122 where the fuel flows up against the venturi tube cover 202 and flows out across the bottom plate 212 out against the peripheral wall 214 and up through the plurality of fuel exit ports 30 as directed by the vertical flame burner cap 54 positioned on top of the circumferential crenellated wall 26. The vertical flame burner cap 54 has an outer cap wall 254, a perforated annular wall 262, and an inner cap wall 258 that direct the flow of fuel 210 through the plurality of fuel exit ports 30 upwardly away from the burner assembly 118. At least one secondary air inlet 138 is shown to assist in the production of the gas-primary air mixture. The vertical burner outer cap wall 254 slides down along the peripheral wall 214 to leave a small gap between the outer cap wall 218 and the ledge member 220. The spreader assembly 140 includes both the swirl spreader 38 and the burner base 34 upon which the vertical flame burner cap 54 is positioned.

In embodiments using the vertical flame burner cap 54, the vertical burner annular wall 262 is perforated with at least one flame aperture 250 for directing fuel 210 in the vertical flame state 62. In some embodiments, the flame apertures 250 of the vertical flame burner cap 54 have a diameter from 1.50 mm to 2.25 mm, an area from 2.25 $mm^2$ to 3.25 $mm^2$, and from 250 to 350 flame apertures. In other embodiments, the flame apertures 250 in the vertical flame burner cap 54 have a diameter from 1.50 mm to 2.00 mm, 1.75 mm to 2.25 mm, 1.70 mm to 1.90 mm, about 1.70 mm, 1.75 mm, 1.80 mm, or about 1.85 mm. In other embodiments, the flame apertures 250 in the vertical flame burner cap 54 have an area from 2.25 $mm^2$ to 3.25 $mm^2$, 2.50 $mm^2$ to 3.00 $mm^2$, 2.50 $mm^2$ to 2.75 $mm^2$, 2.65 $mm^2$ to 3.85 $mm^2$, about 2.60 $mm^2$, about 2.65 $mm^2$, about 2.70 $mm^2$, about 2.75 $mm^2$, or about 2.80 $mm^2$. In other embodiments, the vertical flame burner cap 54 has from 250 to 350 flame apertures, from 275 to 325 flame apertures, from 275 to 300 flame apertures, or about 275 flame apertures, about 280 flame apertures, about 285 flame apertures, about 290 flame apertures, or about 295 flame apertures.

The arrangement of flame apertures 250 may be spaced around the circumference of the vertical burner annular wall 262. In some embodiments, the vertical burner annular wall 262 has three rings of 95 flame apertures 250 with about 4.27 mm space between the flame apertures 250 on the outer ring, 4.15 mm of space between the flame apertures 250 on the middle ring, and 3.97 mm of space between the flame apertures 250 on the inner ring. In some embodiments, the configuration of the flame apertures 250 around the circumference of the vertical burner annular wall 262 may be orientated in any given manner, for example, one or more flame apertures 250 may be positioned in a radial, circular, oval, square, or triangular orientation around the vertical burner annular wall 262. In some embodiments, the flame apertures 250 may be shaped in any geometry, for example, a cylindrical shape, a conical shape, a cubical shape, or a star shape.

In some embodiments, the vertical flame burner cap 54 is coupled to the swirl spreader 38 to block the plurality of fuel exit ports 30 directed generally inwardly toward the combustion chamber 18. In embodiments where the vertical flame state 62 is desired, the vertical flame burner cap 54 has an internal cap diameter 266 having a first inner edge 274 and an outer cap diameter 270 having a second inner edge 278 where the first inner edge 274 couples to a front edge 224 of the circumferential crenellated wall 26 and the second inner edge 278 couples to the back edge 228 of the peripheral wall 214 of the burner base 34 wherein the vertical flame burner cap 54 extends over the circumferential crenellated wall 26 and the peripheral wall 214 of the burner base 34.

Figure 13:
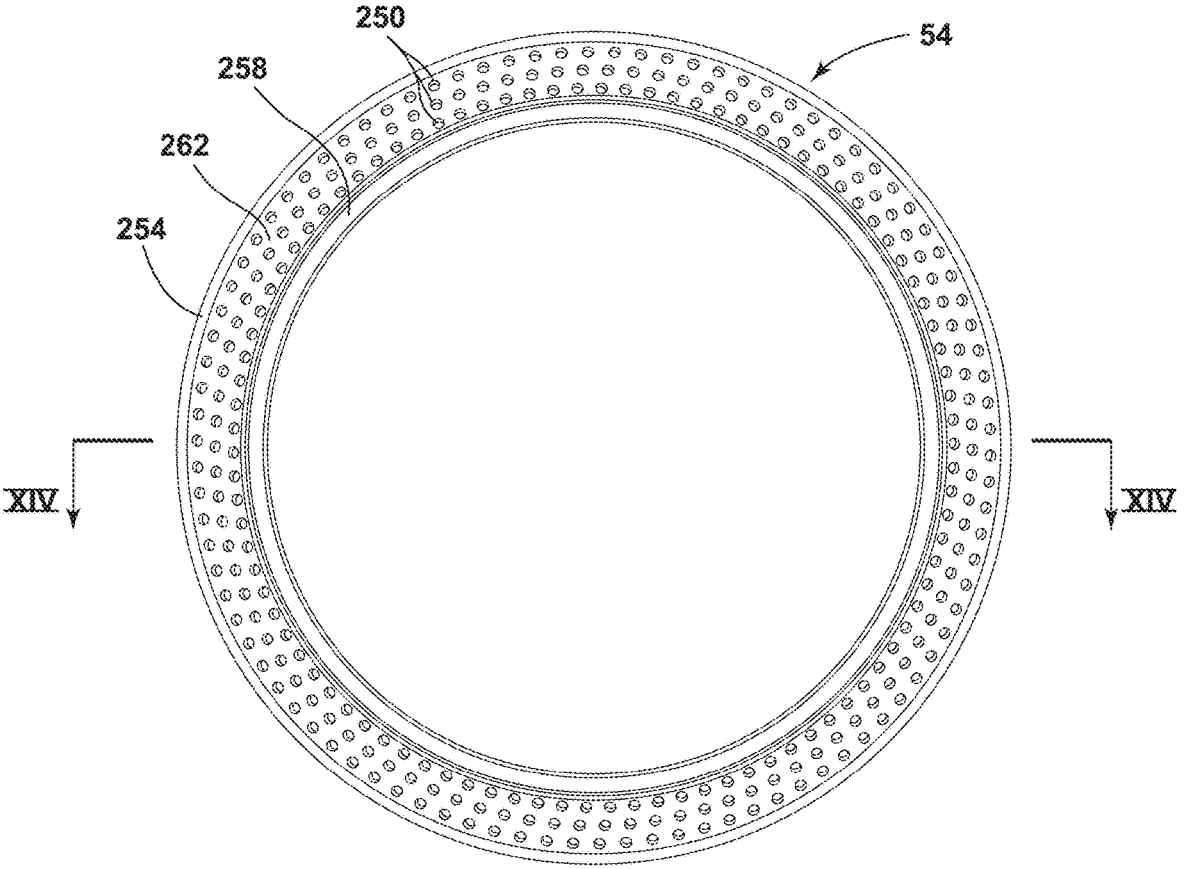
FIG. 13 is a top plan view of a vertical flame cap according to the present disclosure.
Figure 14:
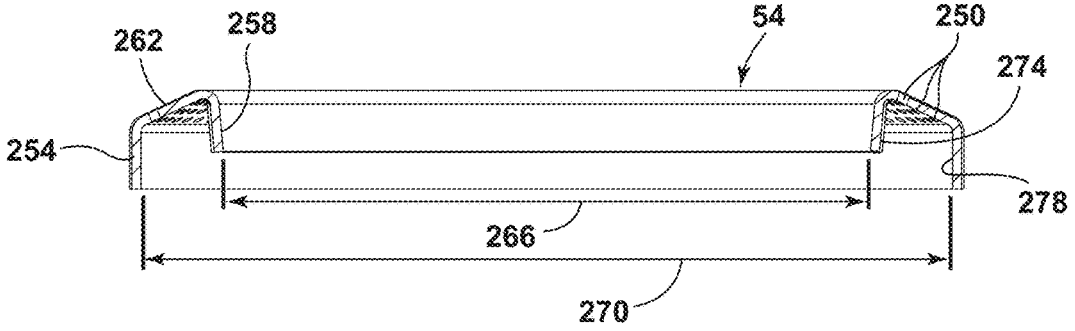
FIG. 14 is a cross-sectional view of the vertical flame cap taken along the line XIV-XIV in FIG. 13.
Figure 15:
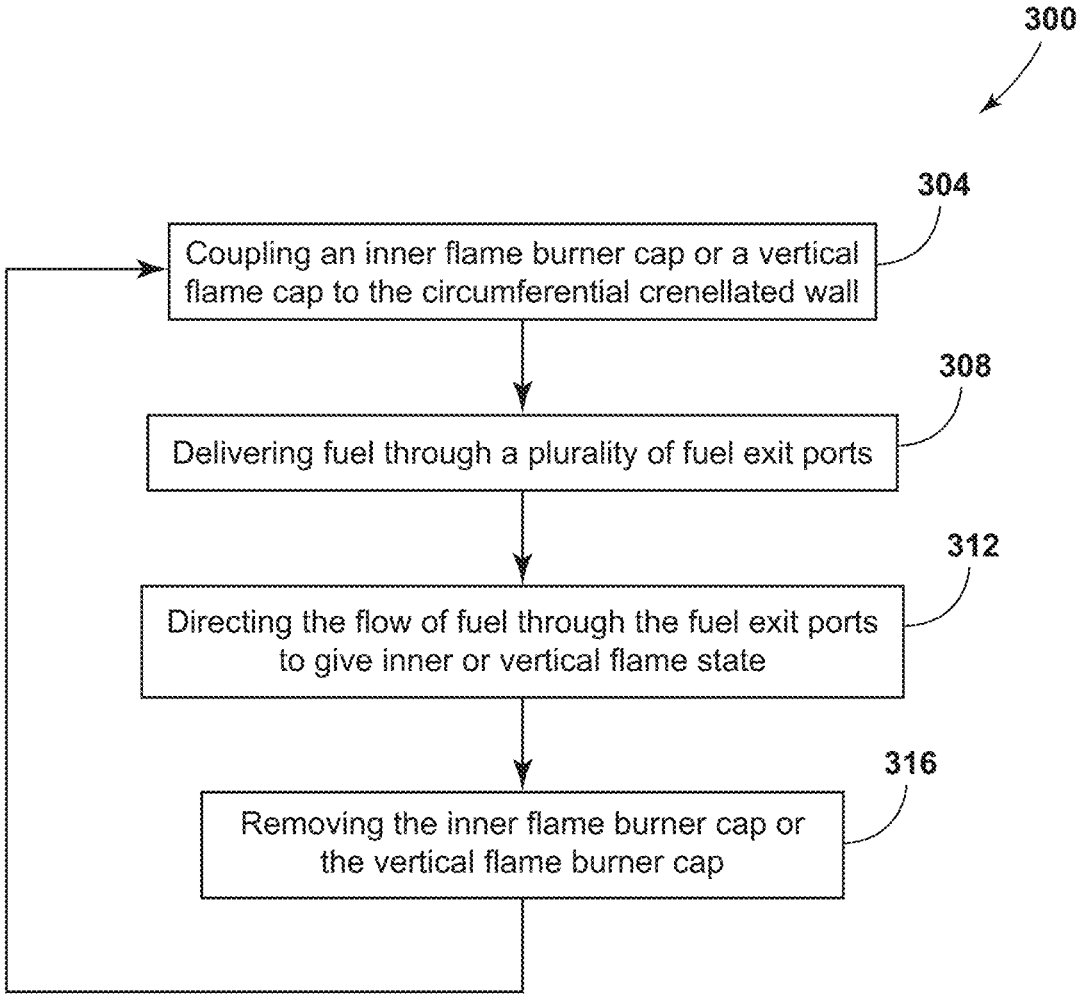
FIG. 15 is a flow diagram of a method for converting between an inner flame state and a vertical flame state.

Referring now to FIGS. 2 and 13-14, the vertical flame burner cap 54 includes the vertical flame burner cap 54 positioned on top of the spreader assembly 140, where it encloses the top of the mixing chamber 130 between the peripheral wall 214 of the burner base 34 and the circumferential crenellated wall 26 of the swirl spreader 38. The vertical flame burner cap 54 also encloses the top 234 of the channels 230, to direct the flow of fuel 210 upwardly away from the burner assembly 118. The vertical flame burner cap 54 is optionally shaped and has the vertical burner outer wall 254 designed to extend over a portion of the peripheral wall 214 of the burner base 34 and pushed down against the ledge member 220 to retain the vertical flame burner cap 54 in position. The vertical flame burner cap 54 additionally has the vertical burner inner wall 258 blocking the inwardly flow of fuel 210 through the plurality of fuel exit ports 30 to redirect the flow of fuel 210 upwardly away from the burner assembly 118 to give the vertical flame state 62. The vertical flame burner cap 54 may also be constructed of any material suitable for use in burner caps, including without limitation a suitable polished brass alloy, iron, or a steel material formed by stamping and sintering metal powder.

The fuel 210 is supplied to the gas burner 10 through the gas inlet 94, and is sprayed through the gas injector orifice 98, into the stem 122. The fuel 210 then travels through the venturi tube 126, where primary air is introduced. The gas and primary air are expelled into the mixing chamber 130, which is defined by the burner base 34, the swirl spreader 38, and the vertical flame burner cap 54. The gas and primary air mixture is then forced through the plurality of fuel exit ports 30 by pressure in the mixing chamber 130, into the combustion chamber 18. The plurality of fuel exit ports 30 direct the gas in an inwardly and upwardly directed swirling configuration. The gas-primary air mixture is ignited in the combustion chamber 18 by the spark electrode 134, and the upwardly swirling directed flame through the flame apertures 250 causes secondary air to enter the combustion chamber 18 through the secondary air inlets 138 in the bottom of the combustion chamber 18 by convection to encourage complete combustion.

The gas burner 10 disclosed herein provides several advantages. For example, cookware placed on the gas burner 10 is heated effectively and efficiently by the swirling inwardly directed flames, with limited heat loss around the exterior of the cookware. Efficiencies of 60% or greater are possible with the vertically projected flames as described herein. The upwardly or vertically directed flames are directed underneath the cookware for a more direct heating source. The aesthetics of the gas burner 10 are improved due to the smooth, uninterrupted viewable flame surface. The vertical flame burner cap 54 described herein can be removed from the burner assembly 118 without disconnecting the swirl spreader 38 from the burner base 34, and replaced in a proper orientation using the asymmetrically arranged tabs 182 and slots 186 described herein.

Referring now to FIGS. 1-15, a method 300 for converting between the inner flame state 58 and the vertical flame state 62 of the gas burner 10 includes, coupling one of the inner flame burner cap 50 and the vertical flame burner cap 54 to the top portion 42 of the circumferential crenellated wall 26 to selectively and alternatively define the inner flame state 58 and the vertical flame state 62 (step 304); delivering the fuel 210 through the plurality of fuel exit ports 30 in the circumferential crenellated wall 26 (step 308); redirecting the flow of fuel 210 from the fuel exit ports 30 indicative of one of the inner flame state 58 and the vertical flame state 62, alternatively (step 312); and removing the inner flame burner cap 50 or the vertical flame burner cap 54 (step 316). In some embodiments, if the inner flame burner cap 50 or the vertical flame burner cap 54 is previously coupled, removing the inner flame burner cap 50 if the vertical flame state 62 is selected or removing the vertical flame burner cap 54 if the inner flame state 58 is selected (step 316). In other embodiments, again determining if the alternative inner flame state 58 or vertical flame state 62 is desired and repeated steps 304, 308, 312 after removing the cap 50, 54 previously coupled. The method 300 can be repeated an indefinite number of times to repeated switch back and forth between the inner flame state 58 and the vertical flame state 62 as desired by the user.

The invention disclosed herein is further summarized in the following paragraphs and is further characterized by combinations of any and all of the various aspects described therein.

According to one aspect of the present disclosure, a burner cap set for a gas burner includes a burner base. The burner base includes a peripheral wall that has a base edge. The burner cap set includes a spreader. The spreader includes a bottom and a crenellated wall that has a top portion and a front edge. The bottom and the crenellated wall defines a combustion chamber. A plurality of fuel exit ports is defined by the crenellated wall, the fuel exit ports being directed generally inwardly toward the combustion chamber and upwardly from the bottom of the combustion chamber. An inner flame burner cap is coupled to the top portion of the crenellated wall that defines an inner flame state projected into the combustion chamber. A vertical flame burner cap is coupled to the top portion of the crenellated wall to define an inner flame state upwardly from the gas burner. The vertical flame state is alternate from the inner flame state. The vertical flame burner cap includes a first inner edge and a second inner edge respectively coupled to the crenellated wall and the peripheral wall of the burner base.

A vertical flame burner cap includes a perforated annular wall having flame apertures that upwardly direct fuel in a vertical flame state.

An inner flame burner cap includes a solid annular wall that inwardly directs fuel in an inner flame state.

A vertical flame burner cap includes an internal cap diameter of the vertical flame burner cap defined by the first inner edge, and an outer cap diameter of the vertical flame burner cap defined by the second inner edge. The first and second inner edges of the vertical flame burner cap are coupled to a front edge of a crenellated wall and a base edge of a burner base. The vertical flame burner cap extends over a crenellated wall and a peripheral wall of the burner base.

A vertical flame burner cap is coupled to a spreader to partially obstruct fuel exit ports and upwardly direct fuel in a vertical flame state.

An inner flame burner cap is coupled to a spreader to partially obstruct fuel exit ports and inwardly direct fuel into a combustion chamber in an inner flame state.

According to another aspect of the present disclosure, a burner assembly includes a spreader, a burner base, and at least one annular burner cap. The spreader has a bottom and a combustion chamber that is defined by a crenellated wall wherein a plurality of fuel exit portions defines the crenellated wall. The burner base includes a peripheral wall. The at least one annular burner cap is coupled to the peripheral wall of the burner base and is positioned on the crenellated wall.

At least one annular cap includes an inner flame burner cap and a vertical flame burner cap. The inner flame burner cap defines an inner flame state and the vertical flame burner cap defines a vertical flame state.

A vertical flame burner cap includes an annular wall. A plurality of flame apertures are disposed along a circumference of the annular wall proximate to fuel exit ports of a crenellated wall.

The burner assembly includes a switchable flame that extends through a plurality of fuel exit ports.

A vertical flame state defines a switchable flame that extends upwardly through a plurality of fuel exit ports of a crenellated wall and flame apertures.

A burner assembly includes a venturi tube and a venturi tube cover that is positioned proximate to a bottom of a spreader. Secondary air inlets defines the bottom and are circumferentially disposed around the venturi tube cover.

According to another aspect of the present disclosure, a gas burner includes a spreader, a burner base, and an annular burner cap. The spreader includes a bottom and a crenellated wall that is defined by a combustion chamber. The crenellated wall has a top portion and is defined by fuel exit ports. The burner base includes a peripheral wall and a ledge member that extends from the peripheral wall. The annular burner cap is coupled to the peripheral wall of the burner base and is positioned on the top portion of the crenellated wall.

An annular burner cap is a vertical flame burner cap and defines a vertical flame state.

A vertical flame burner cap includes an outer cap wall adjacent to a peripheral wall and a ledge member and defines a gap therebetween, and includes an inner cap wall and a perforated annular wall. The inner cap wall obstructs an inward flow of fuel through fuel exit ports. The perforated annular wall defines flame apertures.

Fuel exit ports are aligned with flame apertures and is further defined by a vertical flame state.

An annular burner cap is an inner flame burner cap and defines an inner flame state.

An inner flame burner cap includes a top cap wall, an outer cap wall, and an annular wall. The outer cap wall is adjacent to a peripheral wall and is coupled to a ledge member of a burner base. The annular wall is positioned along the fuel exit ports and is defined by the crenellated wall. A top portion of the crenellated wall is obstructed by the annular wall.

Fuel exit ports are inwardly oriented along a radial line and is further defined by an inner flame state.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and description described above is merely for illustrative purposes and not intended to necessarily limit the scope of the device, which is defined by the following claims as interpreted according to the principles of patent law, including the Doctrine of Equivalents.

What is claimed is:

1. A burner cap set for a gas burner, comprising:

a burner base including a peripheral wall having a base edge;

a spreader including a bottom and a crenellated wall having a top portion and a front edge, wherein the bottom and the crenellated wall define a combustion chamber;

a plurality of fuel exit ports defined by the crenellated wall, wherein the plurality of fuel exit ports are inwardly directed toward the combustion chamber and upwardly extending from the bottom of the spreader;

an inner flame burner cap selectively and alternatively coupled to the top portion of the crenellated wall to define an inner flame state projected into the combustion chamber; and a vertical flame burner cap selectively and alternatively coupled to the top portion of the crenellated wall to define a vertical flame state upwardly projecting from the gas burner, the vertical flame state being selectively alternative to the inner flame state, wherein the vertical flame burner cap includes a first inner edge and a second inner edge respectively coupled to the crenellated wall and the peripheral wall of the burner base.

2. The burner cap set of claim 1, wherein the vertical flame burner cap includes a perforated annular wall having flame apertures that upwardly direct fuel in the vertical flame state.

3. The burner cap set of claim 1, wherein the inner flame burner cap includes a solid annular wall that inwardly directs fuel in the inner flame state.

4. The burner cap set of claim 1, wherein the vertical flame burner cap further includes:

an internal cap diameter of the vertical flame burner cap defined by the first inner edge;

an outer cap diameter of the vertical flame burner cap defined by the second inner edge, wherein the first and second inner edges of the vertical flame burner cap couple to the front edge of the crenellated wall and the base edge of the burner base, and wherein the vertical flame burner cap extends over the crenellated wall and the peripheral wall of the burner base.

5. The burner cap set of claim 1, wherein the vertical flame burner cap is coupled to the spreader to partially obstruct the plurality of fuel exit ports and upwardly direct fuel in the vertical flame state.

6. The burner cap set of claim 1, wherein the inner flame burner cap is coupled to the spreader to partially obstruct the plurality of fuel exit ports and inwardly direct fuel into the combustion chamber in the inner flame state.

7. A burner assembly, comprising:

a spreader having a bottom and a combustion chamber defined by a crenellated wall, wherein a plurality of fuel exit ports are defined by the crenellated wall;

a burner base including a peripheral wall; and at least one annular burner cap coupled to the peripheral wall of the burner base, wherein the annular burner cap includes an inner flame burner cap defining an inner flame state and a vertical flame burner cap defining a vertical flame state, and further wherein the at least one annular burner cap is positioned on the crenellated wall.

8. The burner assembly of claim 7, wherein the vertical flame burner cap includes an annular wall, and wherein a plurality of flame apertures are disposed along a circumference of the annular wall proximate to the plurality of fuel exit ports of the crenellated wall.

9. The burner assembly of claim 8, further including:

a switchable flame extending through the plurality of fuel exit ports.

10. The burner assembly of claim 9, wherein the vertical flame state is defined by the switchable flame upwardly extending through the plurality of fuel exit ports of the crenellated wall and the plurality of flame apertures.

11. The burner assembly of claim 9, wherein the inner flame state is defined by the switchable flame inwardly extending into the combustion chamber through the plurality of fuel exit ports of the crenellated wall.

12. The burner assembly of claim 7, further including:

a venturi tube; and a venturi tube cover positioned proximate to the bottom of the spreader, wherein secondary air inlets are defined by the bottom and are circumferentially disposed around the venturi tube cover.

13. A gas burner, comprising:

a spreader including a bottom and a crenellated wall defining a combustion chamber, wherein the crenellated wall has a top portion, and wherein the crenellated wall defines fuel exit ports;

a burner base having a peripheral wall and a ledge member extending from the peripheral wall; and an annular burner cap coupled to the peripheral wall of the burner base, wherein the annular burner cap is positioned on the top portion of the crenellated wall, and wherein the annular burner cap is a vertical flame burner cap that defines a vertical flame state, the vertical flame burner cap including:

an outer cap wall adjacent to the peripheral wall and the ledge member and defining a gap therebetween;

an inner cap wall, wherein the inner cap wall obstructs an inward flow of fuel through the fuel exit ports; and a perforated annular wall defining flame apertures.

14. The gas burner of claim 13, wherein the fuel exit ports are aligned with the flame apertures to further define the vertical flame state.

15. The gas burner of claim 13, wherein the annular burner cap is an inner flame burner cap that defines an inner flame state.

16. The gas burner of claim 15, wherein the inner flame burner cap further includes:

a top cap wall;

an outer cap wall adjacent to the peripheral wall and coupled to the ledge member of the burner base; and an annular wall circumferentially positioned along the fuel exit ports defined by the crenellated wall, wherein the top portion of the crenellated wall is obstructed by the annular wall.

17. The gas burner of claim 15, wherein the fuel exit ports are inwardly oriented along a radial line to further define the inner flame state.

* * * * *